US009824874B2

(12) United States Patent
Ibrahim et al.

(10) Patent No.: US 9,824,874 B2
(45) Date of Patent: Nov. 21, 2017

(54) ION FUNNEL DEVICE

(71) Applicant: BATTELLE MEMORIAL INSTITUTE, Richland, WA (US)

(72) Inventors: Yehia M. Ibrahim, Richland, WA (US); Tsung-Chi Chen, Richland, WA (US); Marques B. Harrer, Richland, WA (US); Keqi Tang, Richland, WA (US); Richard D. Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 317 days.

(21) Appl. No.: 14/733,517

(22) Filed: Jun. 8, 2015

(65) Prior Publication Data

US 2015/0357174 A1 Dec. 10, 2015

Related U.S. Application Data

(60) Provisional application No. 62/010,036, filed on Jun. 10, 2014.

(51) Int. Cl.
*H01J 49/06* (2006.01)

(52) U.S. Cl.
CPC ..... *H01J 49/066* (2013.01)

(58) Field of Classification Search
CPC ..... H01J 49/066
See application file for complete search history.

(56) References Cited

U.S. PATENT DOCUMENTS

| | | | | |
|---|---|---|---|---|
| 6,462,338 | B1 | 10/2002 | Inatsugu et al. | |
| 2006/0076485 | A1 | 4/2006 | Stoermer et al. | |
| 2011/0012017 | A1 | 1/2011 | Nishiguchi | |
| 2011/0147584 | A1* | 6/2011 | Kim | H01J 49/066 250/292 |
| 2012/0261570 | A1 | 10/2012 | Shvartsburg et al. | |
| 2012/0298853 | A1* | 11/2012 | Kurulugama | H01J 49/065 250/282 |
| 2013/0175440 | A1 | 7/2013 | Perelman et al. | |
| 2013/0175441 | A1 | 7/2013 | Zanon et al. | |
| 2013/0187044 | A1 | 7/2013 | Ding et al. | |

OTHER PUBLICATIONS

International Search Report/Written Opinion for International Application No. PCT/US2012/035059, International Filing Date Jun. 10, 2015, dated Aug. 20, 2015.

Fenn, J. B., et al., Electrospray Ionization for Mass Spectrometry of Large Biomolecules, Science, 246, 1989, 64-71.

Hofstadler, S. A., et al., Applications of ESI-MS in drug discovery: interrogation of noncovalent complexes, Nature Review, Drug Discovery, 5, 2006, 585-595.

(Continued)

*Primary Examiner* — Scott Bauer
(74) *Attorney, Agent, or Firm* — Klarquist Sparkman, LLP

(57) ABSTRACT

An ion funnel device is disclosed. A first pair of electrodes is positioned in a first direction. A second pair of electrodes is positioned in a second direction. The device includes an RF voltage source and a DC voltage source. A RF voltage with a superimposed DC voltage gradient is applied to the first pair of electrodes, and a DC voltage gradient is applied to the second pair of electrodes.

26 Claims, 13 Drawing Sheets

(56) References Cited

OTHER PUBLICATIONS

Shen, Y., et al., Ultrasensitive Proteomics Using High-Efficiency On-Line Micro-SPE-NanoLC-NanoESI MS and MS/MS, Analytical Chemistry, 76, 2003, 144-154.
Fenn, J. B., et al., Electrospray ionization-principles and practice, Mass Spectrometry Reviews, 9, 1990, 37-70.
Crotti, S., et al., Some thoughts on electrospray ionization mechanisms, European Journal of Mass Spectrometry, 17, 2011, 85-100.
Bruins, A. P., Mass spectrometry with ion sources operating at atmospheric pressure, Mass Spectrometry Reviews, 10, 1991, 53-77.
Douglas, D. J., et al., Collisional Focusing Effects in Radio Frequency Quadrupoles, Journal of the American Society for Mass Spectrometry, 3, 1992, 398-408.
Ibrahim, Y., et al., Improving Mass Spectrometer Sensitivity Using a High-Pressure Electrodynamic Ion Funnel Interface, Journal of the American Society for Mass Spectrometry, 17, 2006, 1299-1305.
Page, J. S., et al., Ionization and Transmission Efficiency in an Electrospray Ionization—Mas Spectrometry Interface, Journal of the American Society for Mass Spectrometry, 18, 2008, 1582-1590.
Tang, K., et al., High-Sensitivity Ion Mobility Spectrometry/Mass Spectrometry Using Electrodynamic Ion Funnel Interfaces, Analytical Chemistry, 77, 2005, 333-3339.
Julian, R. R., et al., Ion Funnels for the Masses: Experiments and Simulations with a Simplified Ion Funnel, Journal of the American Society of Mass Spectrometry, 16, 2005, 1708-1712.
Anthony, S. N., et al., A simple electrospray interface based on a DC ion carpet, International Journal of Mass Spectrometry, 371, 2014, 1-7.
Miller, T. A., Spectroscopy of Transient Species produced by Photodissociation or Photoionization in a Supersonic Free-jet Expansion, Journal Chem Soc, Faraday Trans 2: Mol Chem Phys, 82, 1986, 1123-1135.
Kelly, R. T., et al., The Ion Funnel: Theory, Implementations, and Applications, Mass Spectrometry Reviews, 29, 2010, 294-312.
Gerlich, D., Inhomogeneous RF Fields: A Versatile Tool for the Study of Processes With Slow Ions, State-Selected and State-to-State Ion-Molecule Reaction Dynamics, Part 1, Experiment, Wiley, New York, 82, 1992, 1-176.
Guan, S., et al., Stacked-Ring Electrostatic Ion Guide, Journal of the American Society of Mass Spectrometry, 7, 1996, 101-106.
Belov, M. E., et al., Initial Implementation of an Electrodynamic Ion Funnel With Fourier Transform Ion Cyclotron Resonance Mass Spectrometry, Journal of the American Society of Mass Spectrometry, 11, 2000, 19-23.
Shaffer, S. A., et al., An Ion Funnel Interface for Improved Ion Focusing and Sensitivity Using Electrospray Ionization Mass Spectrometry, Analytical Chemistry, 70, 1998, 4111-4119.
Shaffer, S. A. et al., Characterization of an Improved Electrodynamic Ion Funnel Interface for Electrospray Ionization Mass Spectrometry, Analytical Chemistry, 71, 1999, 2957-2964.
Baker, E. S., et al., Ion Mobility Spectrometry—Mass Spectrometry Performance Using Electrodynamic Ion Funnels and Elevated Drift Gas Pressures, Journal of the American Society of Mass Spectrometry, 18, 2007, 1176-1187.
Clowers, B. H., et al., Enhanced Ion Utilization Efficiency Using an Electrodynamic Ion Funnel Trap as an Injection Mechanism for Ion Mobility Spectrometry, Analytical Chemistry, 80, 2008, 612-623.
Kemper, P. R., et al., A new, higher resolution, ion mobility mass spectrometer. International Journal of Mass Spectrometry, 287, 2009, 46-57.
Gaye, M. M., et al., Ion Mobility-Mass Spectrometry Analysis of Serum N-linked Glycans from Esophageal Adenocarcinoma Phenotypes, Journal of Proteome Research, 11, 2012, 6102-6110.
Koeniger, S. L., et al., An IMS-IMS Analogue of MS-MS, Analytical Chemistry, 78, 2006, 4161-4174.
May, J. C., et al., Conformational Ordering of Biomolecules in the Gas Phase: Nitrogen Collision Cross Sections Measured on a Prototype High Resolution Drift Tube Ion Mobility-Mass Spectrometer, Analytical Chemistry, 86, 2014, 2107-2116.
Siems, W. F., et al., Measuring the Resolving Power of Ion Mobility Spectrometers, Analytical Chemistry, 66, 1994, 4195-4201.
Webb, I. K., et al., Experimental Evaluation and Optimization of Structures for Lossless Ion Manipulations for Ion Mobility Spectrometry with Time-of-Flight Mass Spectrometry, Analytical Chemistry, 86, 2014, 9169-9176.
Webb, I. K., et al., Mobility-Resolved Ion Selection in Uniform Drift Field Ion Mobility Spectrometry/Mass Spectrometry: Dynamic Switching in Structures for Lossless Ion Manipulations, Analytical Chemistry, 86, 2014, 9632-9637.
Garimella, S. V. B., et al., Simulation of Electric Potentials and Ion Motion in Planar Electrode Structures for Lossless Ion Manipulations (SLIM), Journal of the American Society of Mass Spectrometry, 25, 2014, 1890-1896.
Tolmachev, A. V., et al., Characterization of Ion Dynamics in Structures for Lossless Ion Manipulations, Analytical Chemistry, 86, 2014, 9162-9168.
Kelly, R. T., et al., Chemically Etched Open Tubular and Monolithic Emitters for Nanoelectrospray Ionization Mass Spectrometry, Analytica Chemistry, 78, 2006, 7796-7801.
Stephenson, J. L.., et al., Analysis of Biomolecules Using Electrospray Ionization-Ion-Trap Mass Spectrometry and Laser Photodissociation. Bioehemical and Biotechnological Applications of Electrospray Ionization Mass Spectrometry; American Chemical Society; Washington, C, 619, 1996, 512-564.

* cited by examiner

ION FUNNEL DEVICE

CROSS-REFERENCE TO RELATED APPLICATIONS

This application claims priority to U.S. Provisional Application Ser. No. 62/010,036, filed Jun. 10, 2014, titled "RECTANGULAR ION FUNNEL," hereby incorporated by reference in its entirety for all of its teachings.

STATEMENT REGARDING FEDERALLY SPONSORED RESEARCH OR DEVELOPMENT

This invention was made with Government support under Contract DE-AC05-76RL01830 awarded by the U.S. Department of Energy and Grant R01-GM099549 awarded by the National Institutes of Health. The Government has certain rights in the invention.

TECHNICAL FIELD

This invention relates to ion funnels. More specifically, this invention relates to an ion funnel device wherein a first pair of electrodes and a second pair of electrodes are positioned in different directions.

BACKGROUND

The ion funnel has become a well-established interface for enabling the manipulation and focusing of ions between an ion source at the entrance of the ion funnel and an ion mobility or other ion manipulation device at the exit of the ion funnel. Current ion funnel interfaces, which have circular ring electrodes with a focusing lens at the exit, as depicted in FIG. 1, provide only limited ion transmission due to unmatched fields between the ion funnel and the ion manipulation devices, of noncircular entrance, at the exit of the ion funnel. This constitutes a geometric and field mismatch that results in ion loss at the ion funnel-ion mobility device interface.

What is needed is an ion funnel device that provides better sensitivity, higher-efficiency ion transfer, and stable performance for an extensive period of time.

SUMMARY

The present invention is directed to an ion funnel device and method of making the device. In accordance with one embodiment of the present invention, an ion funnel device is disclosed. The ion funnel device includes a first pair of electrodes positioned in a first direction. The ion funnel device also includes a second pair of electrodes positioned in a second direction. The ion funnel device further includes a RF voltage source and a DC voltage source, wherein a RF voltage with a superimposed DC voltage gradient is applied to the first pair of electrodes, and a DC voltage gradient is applied to the second pair of electrodes.

In one embodiment, each of the electrodes in the first direction has a RF phase that is phase shifted approximately 180 degrees from an adjacent first direction electrode.

In one embodiment, the first pair of electrodes are central rung electrodes positioned in a y direction, and the second pair of electrodes are guard electrodes positioned in a x direction.

The inlet and outlet of the ion funnel device may be coupled to other devices. The outlet of the ion funnel device may be coupled but not limited to one of the following devices: an ion mobility device, a separate ion funnel device, and a mass spectrometer device. The inlet of the ion funnel device is coupled but not limited to a separate ion funnel device or an ion source such as electrospray ionization (ESI).

The ion funnel device may include a DC bias range which depends on the length of the operational DC gradient of the ion funnel. For example, for a 20 cm long ion funnel with a 50 V/cm gradient, the device would include a DC bias of approximately 1000V. In another embodiment, the DV bias range is from approximately −100 V to approximately +100 V for the inlet and the outlet of the ion funnel device.

In one embodiment, the RF frequency applied to the electrodes is in the range of 0.1 kHz to 50 MHz, and the RF amplitude applied to the electrodes is in the range of 1 V to 500 V.

The ion funnel device may be formed using printed circuit boards, 3D printing, additive printing, and/or metal lens.

In one embodiment, the distance between each pair of electrodes varies from the inlet of the ion funnel device to the outlet of the ion funnel device.

The distance between the pairs of electrodes at the outlet of the device is smaller than the distance between the pairs of electrodes at the inlet of the device.

The shape of the electrodes may be, but is not limited to, at least one of the following: rectangular, circular, semicircular, or curved.

The ions moving through the device are moving in a third direction, which is different from the first and second directions, in a direction from the inlet of the device toward the outlet of the device.

In another embodiment of the present invention, a method of making an ion funnel device is disclosed. The method includes positioning a first pair of electrodes in a first direction. The method also includes positioning a second pair of electrodes in a second direction. The method further includes applying a RF voltage with a superimposed DC voltage gradient to the first pair of electrodes, and applying a DC voltage gradient to the second pair of electrodes.

In another embodiment of the present invention, an ion funnel device is disclosed. The ion funnel device includes a first pair of electrodes positioned in a first direction and a second pair of electrodes positioned in a second direction. The ion funnel device also includes a RF voltage source and a DC voltage source. A RF voltage with a superimposed DC voltage gradient is applied to the first pair of electrodes. A DC voltage gradient is applied to the second pair of electrodes, and ions moving through the device travel in a third direction.

DETAILED DESCRIPTION OF THE PREFERRED EMBODIMENTS

The following description includes the preferred best mode of embodiments of the present invention. It will be clear from this description of the invention that the invention is not limited to these illustrated embodiments but that the invention also includes a variety of modifications and embodiments thereto. Therefore the present description should be seen as illustrative and not limiting. While the invention is susceptible of various modifications and alternative constructions, it should be understood, that there is no intention to limit the invention to the specific form disclosed, but, on the contrary, the invention is to cover all modifications, alternative constructions, and equivalents falling within the spirit and scope of the invention as defined in the claims.

Disclosed are apparatuses and methods of designing and fabricating an ion funnel device. The ion funnel device may be used as an interface that seamlessly couples to ion manipulation, ion mobility, ion source, and/or convention ion funnel devices. In one embodiment, the ion funnel device couples to an ion manipulation device described in U.S. Pat. No. 8,835,839, entitled "Ion Manipulation Device" (hereinafter referred to as the "SLIM Device").

Figure 1:
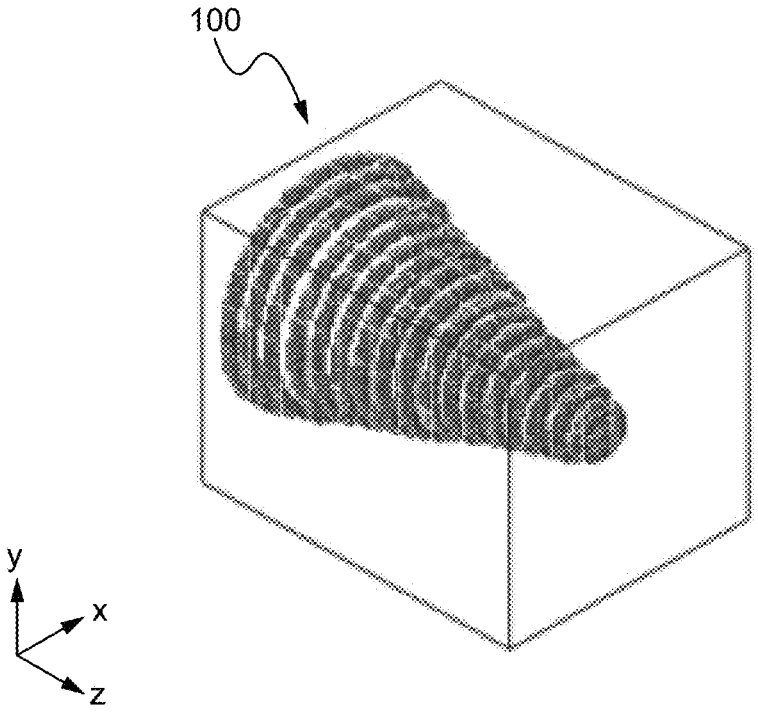
Fig. 1 (Prior Art)
FIG. 1 shows a conventional ion funnel.
Figure 2A:
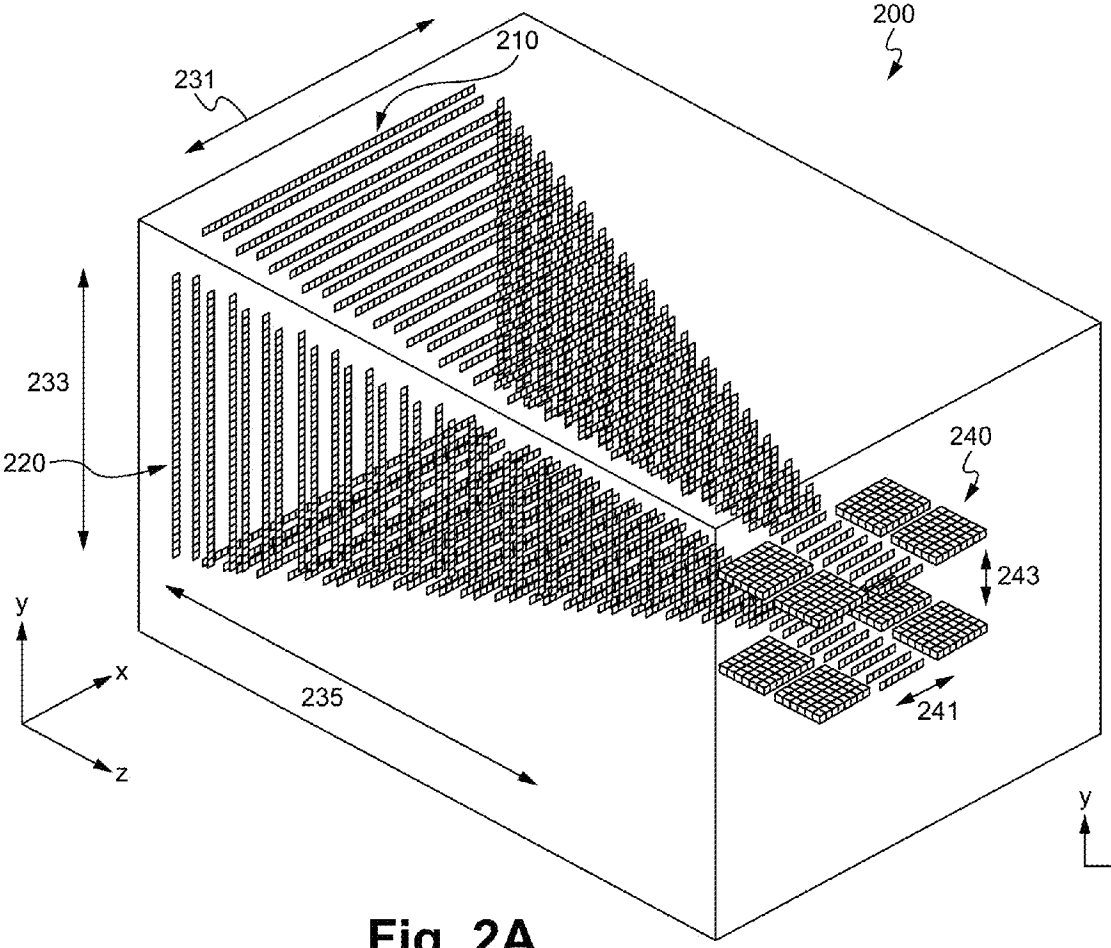
FIG. 2A is a schematic diagram of an ion funnel device containing a first pair of electrodes positioned in the y direction and a second pair of electrodes positioned in the x direction, coupled to an ion mobility device at the exit of the ion funnel, in accordance with one embodiment of the present invention.

FIG. 2A is a schematic diagram of an electrode design 200 for an ion funnel device 200 coupled to a SLIM Device 240, in accordance with one embodiment of the present invention. The ion funnel device contains a first pair of electrodes 210 positioned in the y direction and a second pair of electrodes 220 positioned in the x direction. The SLIM Device 240 is coupled at the exit of the ion funnel device 200.

The dimensions of the ion funnel device 200 decrease from the entrance (or inlet) to the exit (or outlet) of the device 200. The decrease may be linear or non-linear. As one example, the distance between the pairs of electrodes at the outlet of the device is smaller than the distance between the pairs of electrodes at the inlet of the device. In one particular embodiment, the inlet of the ion funnel device 200 has a dimension of 25.0×25.0 mm in the x direction 231 and they direction 233, and the outlet of the ion funnel device 200 has a dimension of 5.0×5.0 mm in the x and y directions, forming an overall approximately 83 mm-long 235 device. In this example, the ions would be traveling in the z-direction. It should be noted that other numerical dimensions and lengths can be used for the ion funnel device 200. For example, the inlet of the ion funnel device 200 can have a dimension of 15.0×15.0 in the x and y directions, with outlet dimensions of 2.5×2.5 mm in the x and y directions.

It should also be noted that different coordinate planes can be used to define the electrodes of the ion funnel device 200. For example, the first pair of electrodes 210 and the second pair of electrodes 220 can be defined in the xz-plane or the yz-plane and, therefore, the ions can travel in a direction other than the z-direction.

Still referring to FIG. 2A, the SLIM Device 240 also includes numerical dimensions in the y direction 243 and the x-direction 241. The outlet or exit dimensions of the ion funnel device 200 should align with the inlet or entrance dimensions of the SLIM Device 240. It should be noted that the outlet of the ion funnel device 200 can be coupled to other instruments such as, but not limited to, a mass spectrometer device, a separate ion funnel device, or a different ion mobility device. Likewise, the entrance of the ion funnel device 200 can be coupled to one of a number of instruments such as, but not limited to, a separate ion funnel device or an ion source.

Figure 2B:
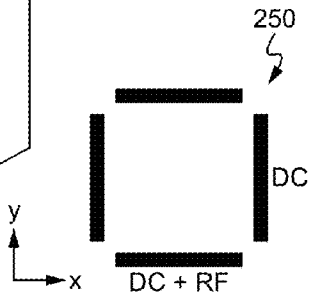
FIG. 2B is a simplified diagram of an ion funnel device with RF and DC voltages applied to one of the two pairs of electrodes, and only a DC voltage applied to the other pair of electrodes, in accordance with one embodiment of the present invention.

FIG. 2B is a simplified diagram of an ion funnel device 250 with RF and DC voltages applied to one of the two pairs of electrodes, and only a DC voltage applied to the other pair of electrodes, in accordance with one embodiment of the present invention. In one embodiment, the RF voltage with a superimposed DC voltage gradient is applied to the electrodes positioned in the y direction, and a DC voltage gradient is applied to the electrodes positioned in the x direction. The DC voltage gradients applied in the x- and y-directions may be the same or different.

Figure 2C:
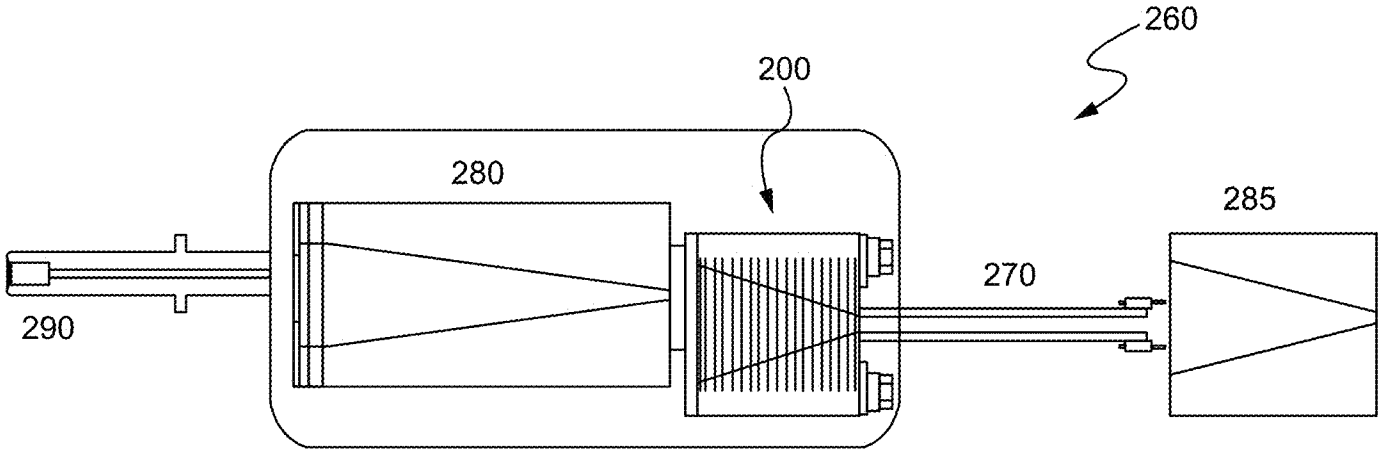
FIG. 2C shows an ion funnel device interface coupled between a conventional ion funnel at the entrance of the ion funnel interface and an ion mobility device at the exit of the ion funnel interface, in accordance with one embodiment of the present invention.

FIG. 2C shows an apparatus 260 for an ion funnel device 200 interface coupled between a conventional ion funnel 280 at the entrance of the ion funnel interface and an ion mobility device or SLIM Device 270 at the exit of the ion funnel interface, in accordance with one embodiment of the present invention. In this particular embodiment, the conventional ion funnel device 280 is also coupled to an ion source 290, and the SLIM Device 270 is coupled to a conventional ion funnel 285.

Figure 6A:
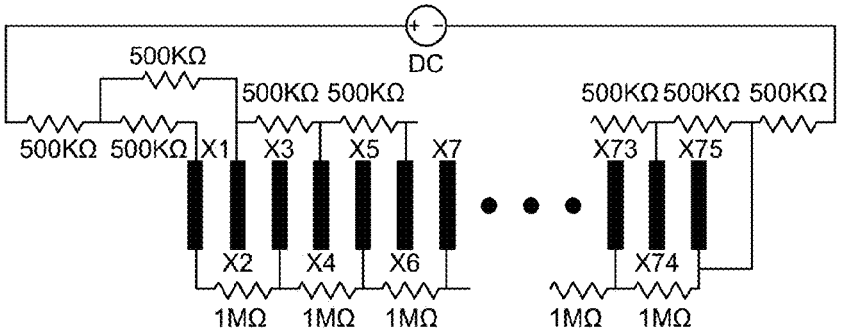
FIG. 6A is a schematic circuit diagram for one of the pairs of electrodes of the ion funnel device with only a DC voltage gradient applied to the electrodes, in accordance with one embodiment of the present invention.

FIG. 6A is a schematic circuit diagram for one of the pairs of electrodes of the ion funnel device with only a DC voltage gradient applied to the electrodes, in accordance with one embodiment of the present invention.

Figure 6B:
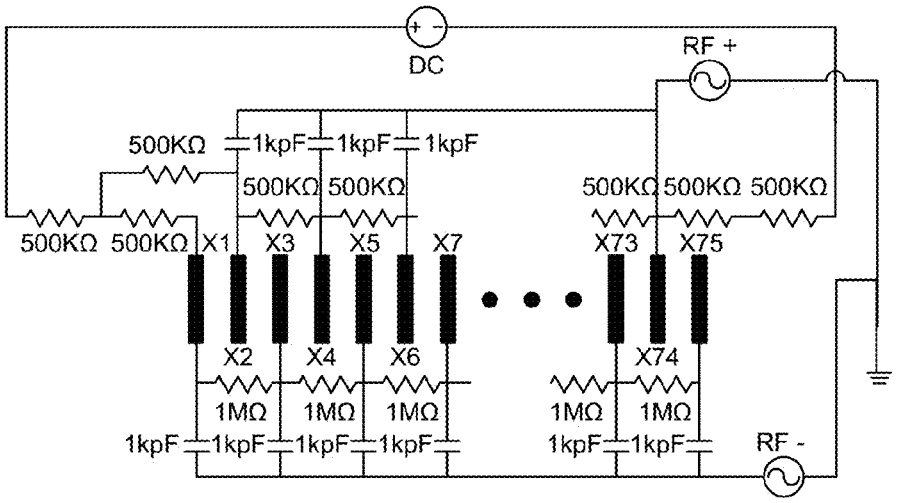
FIG. 6B is a schematic circuit diagram for one of the pairs of electrodes of the ion funnel device with both RF and DC voltages applied to the electrodes, in accordance with one embodiment of the present invention.

FIG. 6B is a schematic circuit diagram for one of the pairs of electrodes of the ion funnel device with both RF and DC voltages applied to the electrodes, in accordance with one embodiment of the present invention.

Figure 7:
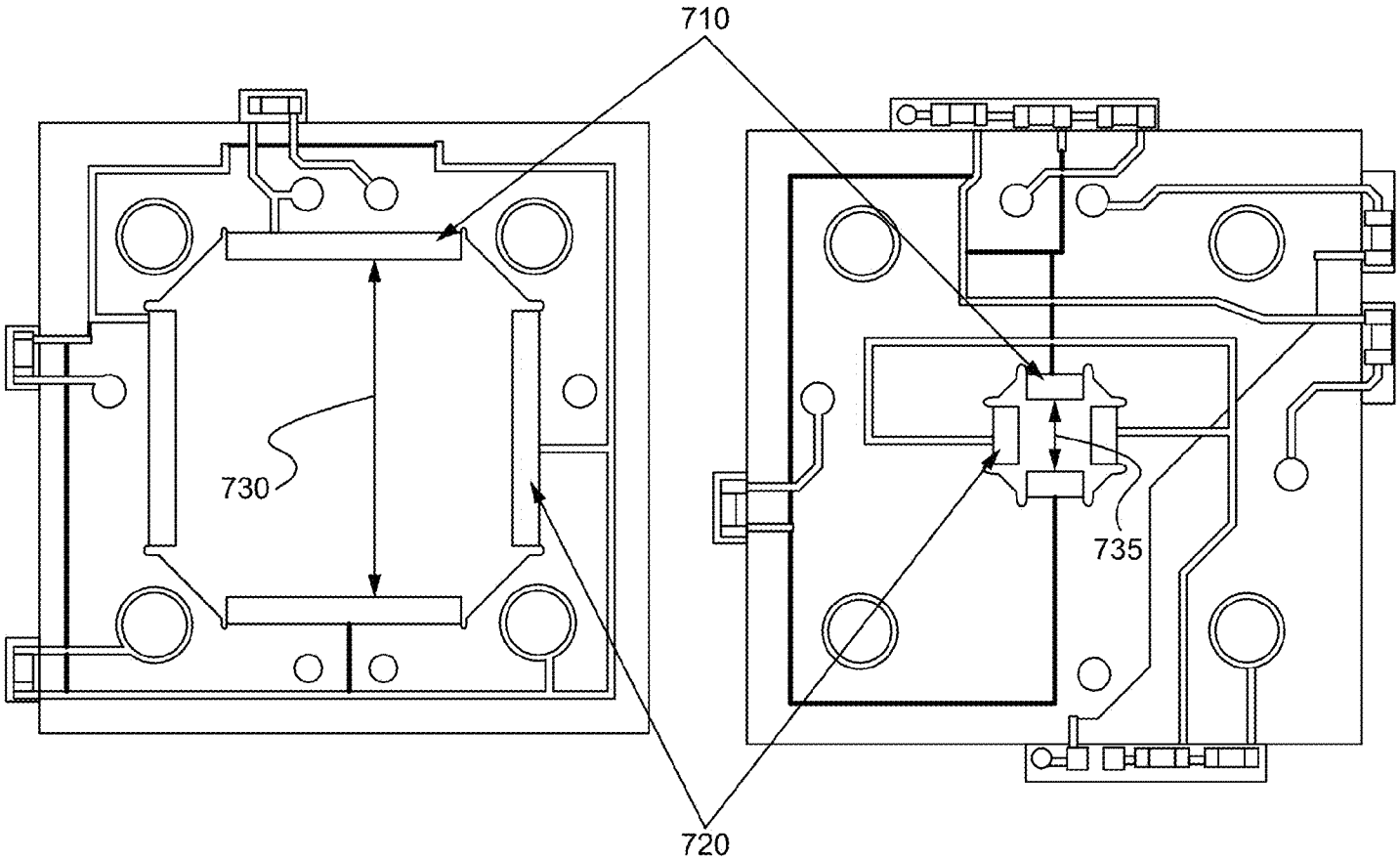
FIG. 7 shows images of a printed circuit board-based ion funnel device, in accordance with one embodiment of the present invention.

FIG. 7 shows images of a printed circuit board-based ion funnel device, in accordance with one embodiment of the present invention. The figure on the left shows the first pair of electrodes 710 and the second pair of electrodes 720 near the entrance of the ion funnel device, with an entrance dimension 730. The figure on the right shows the first pair of electrodes 710 and the second pair of electrodes 720 near the exit of the ion funnel device, with an exit dimension. The ion funnel decreases from the entrance to the exit of the device. Also, as one example, RF and DC voltages are superimposed on one of the pairs of electrodes, while only DC voltage is applied to the other pair. In FIG. 7, as one embodiment, RF voltage and DC gradient is applied to the electrodes 710, while a DC gradient is applied to the electrodes 720.

EXPERIMENTAL SECTION

The following examples serve to illustrate embodiments and aspects of the present invention and should not be construed as limiting the scope thereof.

In this example, the design of the new ion funnel device is evaluated, including its interface to the SLIM Device, and its integration into a ion funnel trap-SLIM Device-time-of-flight mass spectrometer (IFT-SLIM-TOF-MS) instrument. The performance and ion transmission were evaluated, and significant gains in sensitivity were achieved.

Experimental Design

Materials.

Agilent ESI-L low concentration tuning mix (Agilent Technologies, Santa Clara, Calif.) was used to produce ions with m/z range from 118.09 to 2721.89 in ESI positive mode for the ion funnel device optimization and the sensitivity evaluation.

Ionization Source.

The electrospray ionization (ESI) source used in this study consisted of a chemically etched emitter (20 μm i.d.) connected to a 75 μm i.d. fused-silica capillary (Polymicro Technologies, Phoenix, Ariz.) through a zero volume stainless steel union (Valco Instrument Co. Inc., Houston, Tex.). A syringe pump (Fusion 100, Chemyx Inc., Stafford, Tex.) with a 250 μL, syringe (Hamilton, Reno, Nev.) was used to infuse solutions at a flow rate of 300 nL/min. An ionization voltage of 3 kV (relative to the inlet capillary voltage) was applied to the stainless steel union.

Ion Sampling Interfaces.

Positive ions generated from ESI were introduced through a heated capillary (140° C.) into a tandem ion funnel interface consisting of a conventional ion funnel followed by the ion funnel device described in FIGS. 2A-2C. The two ion funnels were operated as follows: conventional ion funnel RF 150 $V_{pp}$ at 800 kHz and DC gradient at 15 V/cm; the ion funnel device (described in FIGS. 2A-2C) RF frequency at 800 kHz. The inlet capillary was offset 9.3 mm from the conventional ion funnel centerline to reduce any gas dynamic effects in the ion funnel device described in FIGS. 2A-2C.

Acquisition.

Mass spectrometer (MS) data was acquired using Mass-Hunter software (Agilent Technologies, Santa Clara, Calif.) utilizing three replicates to calculate the mean and the standard error.

Results and Discussion

Ion Simulations.

The electrode design of the ion funnel device was guided by ion simulations prior to fabrication. The simulations of ion trajectories within the ion funnel device utilized SIMION 8.1 (Scientific Instrument Services, Inc., Ringoes, N.J.) with the SDS (statistical diffusion simulation) user program to model the effects of collisions of charge particles (mass range of m/z 50-2050) with background nitrogen molecules gas at a 4 Torr environment. In contrast to the conventional ion funnel designs using ring electrodes, the ion funnel device utilizes 2 pairs of electrodes, which may be planar and which may form a rectangular outlet, to better match a rectangular SLIM Device entrance dimensions. For the simulations, the ion funnel device, as shown in FIG. 2A, was designed with entrance dimensions of 25.0×25.0 mm, 5.0×5.0 mm for the exit, and 50.9 mm for the length of the ion funnel device converging section. The 34 electrodes used in the simulation were 0.76 mm thick and spaced 0.76 mm apart. For optimum interfacing, the electrical fields applied to the ion funnel device were made similar to SLIM Device. Similar to the SLIM Device electrodes, the rectangular electrodes on each element or lens include a pair of "central rung" electrodes in the y direction with superimposition of DC and RF voltages and a pair of "guard" electrodes in the x direction with DC-only voltages. The field continuity provided by the optimized voltages is expected to provide smooth ion transmission through the ion funnel device-SLIM Device interface.

Figure 5A:
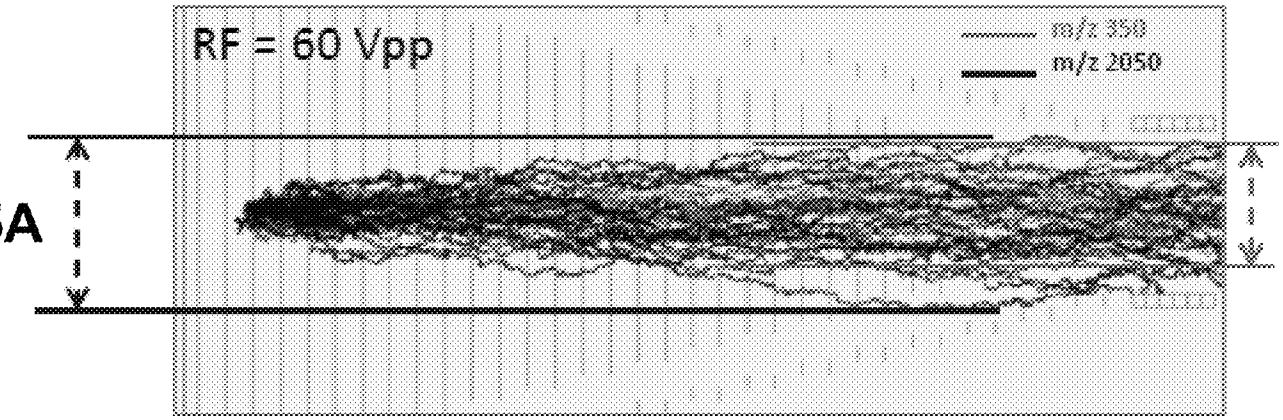
FIGS. 5A-5B show the results of simulations of confinement of the ions in the ion funnel device using a RF voltage of 60 Vpp (FIG. 5A) and 300 Vpp (FIG. 5B).
Figure 5B:
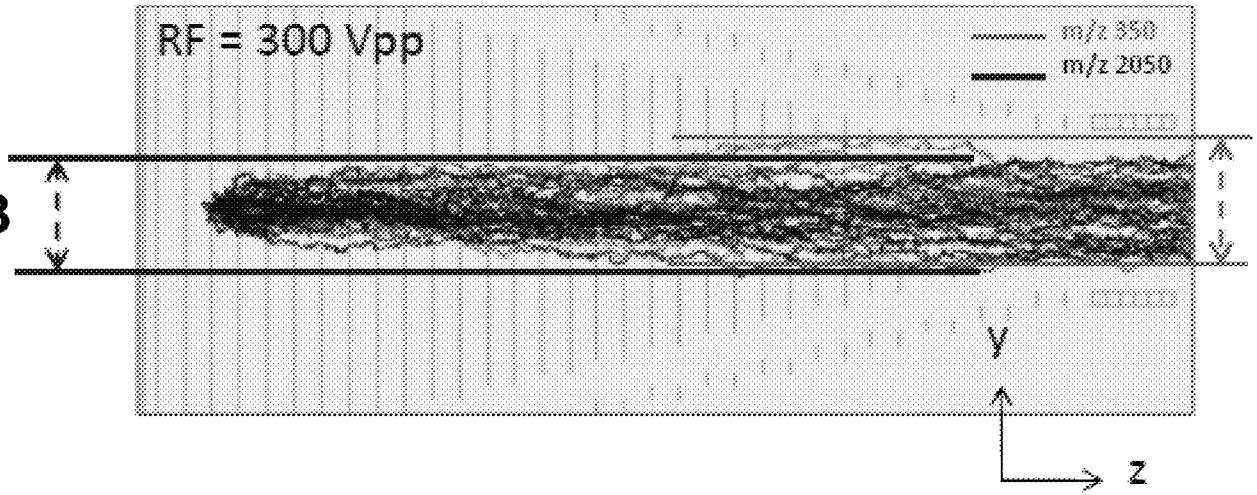

The design was first evaluated with simulations by introducing a wide range of ions (m/z 50-2050, in 200 m/z steps with 5 ions for each m/z) at the entrance of the ion funnel device to model the effect of RF confinement and without considering effects due to excessive space charge. The ion motion was monitored for different RF parameters, particularly at the ion funnel device-SLIM Device junction. In FIGS. 5A and 5B, selected ion trajectories of m/z 350 and 2050 ions are illustrated with RF frequency at 800 kHz and electric field at 20 V/cm. The DC bias of the guard electrodes relative to the central rung electrodes of the ion funnel device was set to 1 V ($\Delta V_{RIF_bias}=V_{guard}-V_{rung}$), while the SLIM Device guard bias was set to 5 V (as optimized previously). The ion trajectories remain primarily within the confining region of the ion funnel device and SLIM Device electrodes with RF amplitudes ranging from 60 $V_{pp}$ in FIG. 5A to 300 $V_{pp}$ in FIG. 5B. The results showed that higher RF amplitudes are necessary to focus higher m/z ions, e.g., the ions of m/z 2050 (the blue trajectories). The effective potential (V*) for the averaged motion of ions in the fast oscillatory field can be described as $$V^* = \frac{q^2 E_o}{4m\Omega^2}$$

where $E_0$ is the amplitude of the oscillatory field, q and m are ion charge and mass of the ion, and Ω is the angular frequency of the oscillatory field. Accordingly, heaver ions experience less RF confinement which results in weaker ion focusing for higher m/z ions.

Figure 3A:
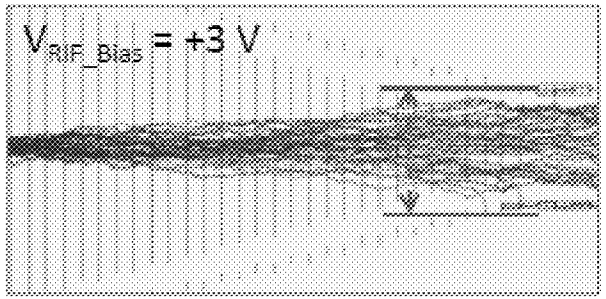
FIGS. 3A-3F show the results of simulations for one of the two pairs of electrodes of the ion funnel device, where a DC bias of +3 V was used in FIGS. 3A and 3D, a DC bias of +1 V was used in FIGS. 3B and 3E, and a DC bias of −5 V was used in FIGS. 3C and 3F.
Figure 3B:
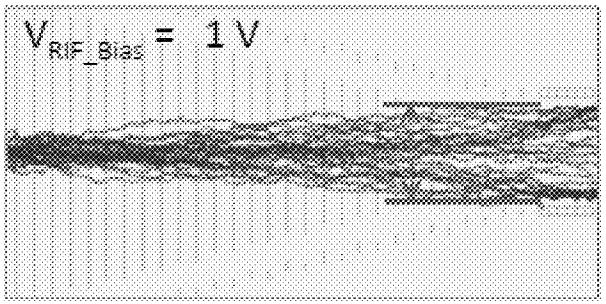
Figure 3C:
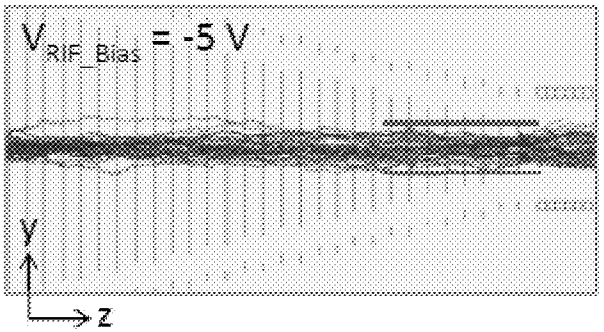
Figure 3D:
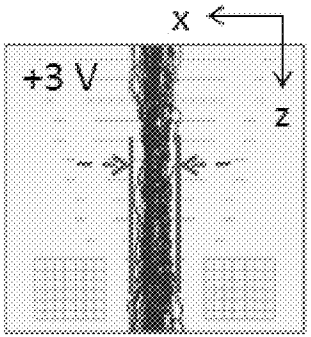
Figure 3E:
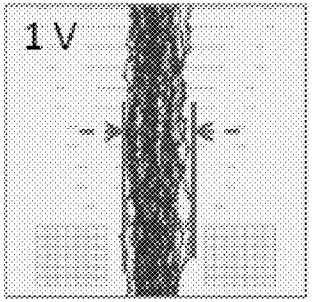
Figure 3F:
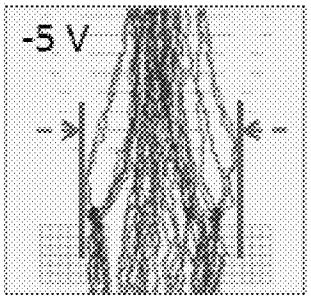

The ion distribution profile in the xy plane can be optimized by adjusting DC penetrations in the ion drifting area. To evaluate the effect of the guard DC bias on the ion transmission, the simulation was performed under the conditions of RF amplitude at 300 $V_{pp}$ and frequency at 800 kHz and electric field strength at 20 V/cm for the ion funnel device. The results in FIG. 3A-3F, where a DC bias of +3 V was used in FIGS. 3A and 3D, a DC bias of +1 V was used in FIGS. 3B and 3E, and a DC bias of −5 V was used in FIGS. 3C and 3F, show ion dispersion in different directions with the exception of FIGS. 3B and 3E where the ions were nearly equally dispersed in both directions.

Figure 4A:
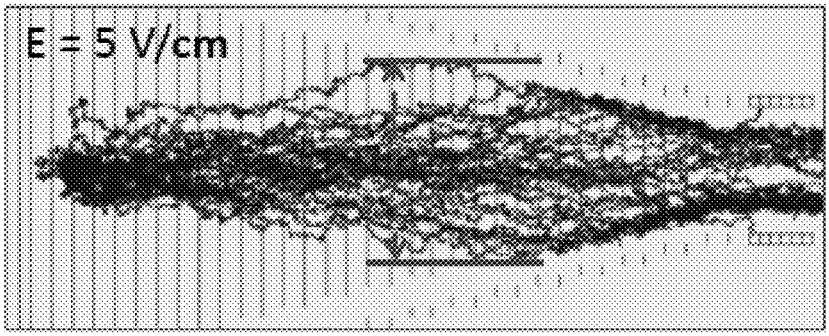
FIGS. 4A-4C show the results of simulations for one of the two pairs of electrodes of the ion funnel device, where the DC gradient along the electrodes on the ion funnel device was varied from 5 V/cm (FIG. 4A), 10 V/cm (FIG. 4B), and to 20 V/cm (FIG. 4C).
Figure 4B:
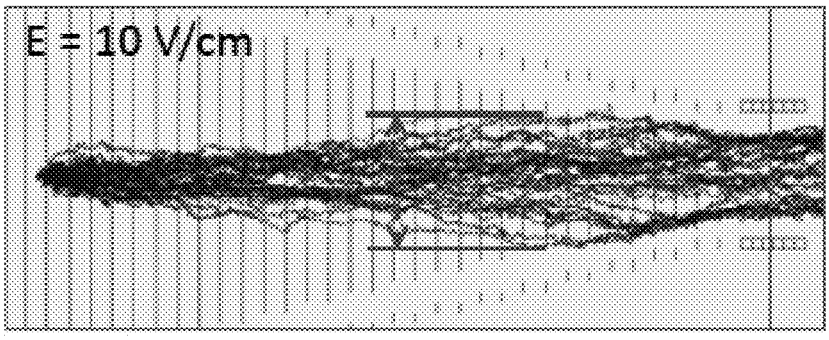
Figure 4C:
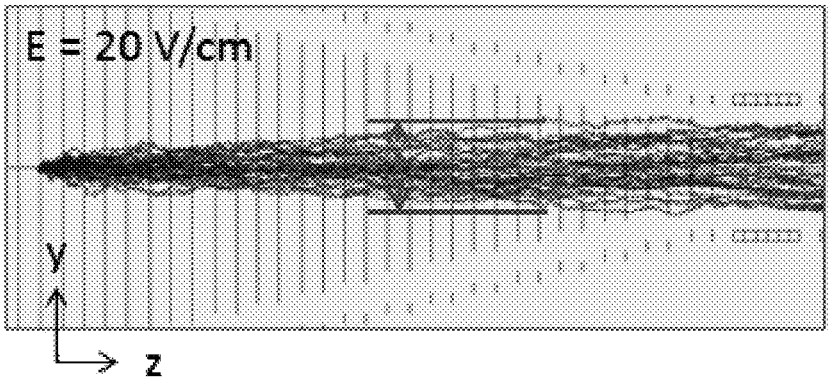

The effect of the DC gradient was also explored in the simulation in order to optimize the electric field for the ion funnel device. In the simulations, the operating parameters for the ion funnel device and SLIM Device were fixed at RF 300 $V_{pp}$ and 800 kHz, while the guard DC biases for the ion funnel device and for SLIM device were 1 and 5 V, respectively. The DC gradient applied on the central rung electrodes was varied from 5 to 20 V/cm, as shown in FIGS. 4A-4C. The results of the simulations (FIGS. 4A-4C) indicated better transmission of ions for DC gradients of 10-20 V/cm. Some ion losses were observed at an electric field below 10 V/cm, presumably due to diffusion and/or space charge effects.

Ion Funnel Device Design and Fabrication.

FIG. 7 shows the images of the ion funnel device entrance and exit lens, fabricated utilizing PCB technology. Each lens has two electrode pairs forming a rectangle shape laid down on a thin dielectric material. As mentioned above, RF and DC are superimposed on one pair of electrodes while only DC is applied to the other pair of electrodes. The electrodes are gold-plated copper material with a thickness of 50 μm and 2.0 mm wide. The ion funnel device lenses are 0.76 mm thick and spaced 0.76 mm apart in the z direction to match the current electrode dimensions used in SLIM Device for this example. The first 21 lenses have a constant electrode separation in a dimension of 25.0×25.0 mm (in x and y directions), and the last 34 lenses dimensions decrease linearly from 25.0×25.0 mm to 5.0×5.0 mm, forming an overall approximately 83 mm-long device.

The x-pair electrodes on each element are connected to a DC power supply while the y-pair electrodes on the same lens are supplied with the superposition of a DC voltage and a RF waveform. Adjacent y-pair electrodes on subsequent lenses in the axial direction have a RF waveform of equal amplitude but opposite phase to produce RF ion confinement in the y-direction. The DC voltages applied on the ion funnel device gradually decreases toward the exit of the funnel to drive ions along the axial direction (z).

Ion Funnel Device Characterization.

The instrument arranged used to characterize the ion funnel device consisted of a conventional ion funnel coupled to the entrance of the ion funnel device and a charge detector placed at the exit of the ion funnel device to evaluate the ion transmission.

Figure 9:
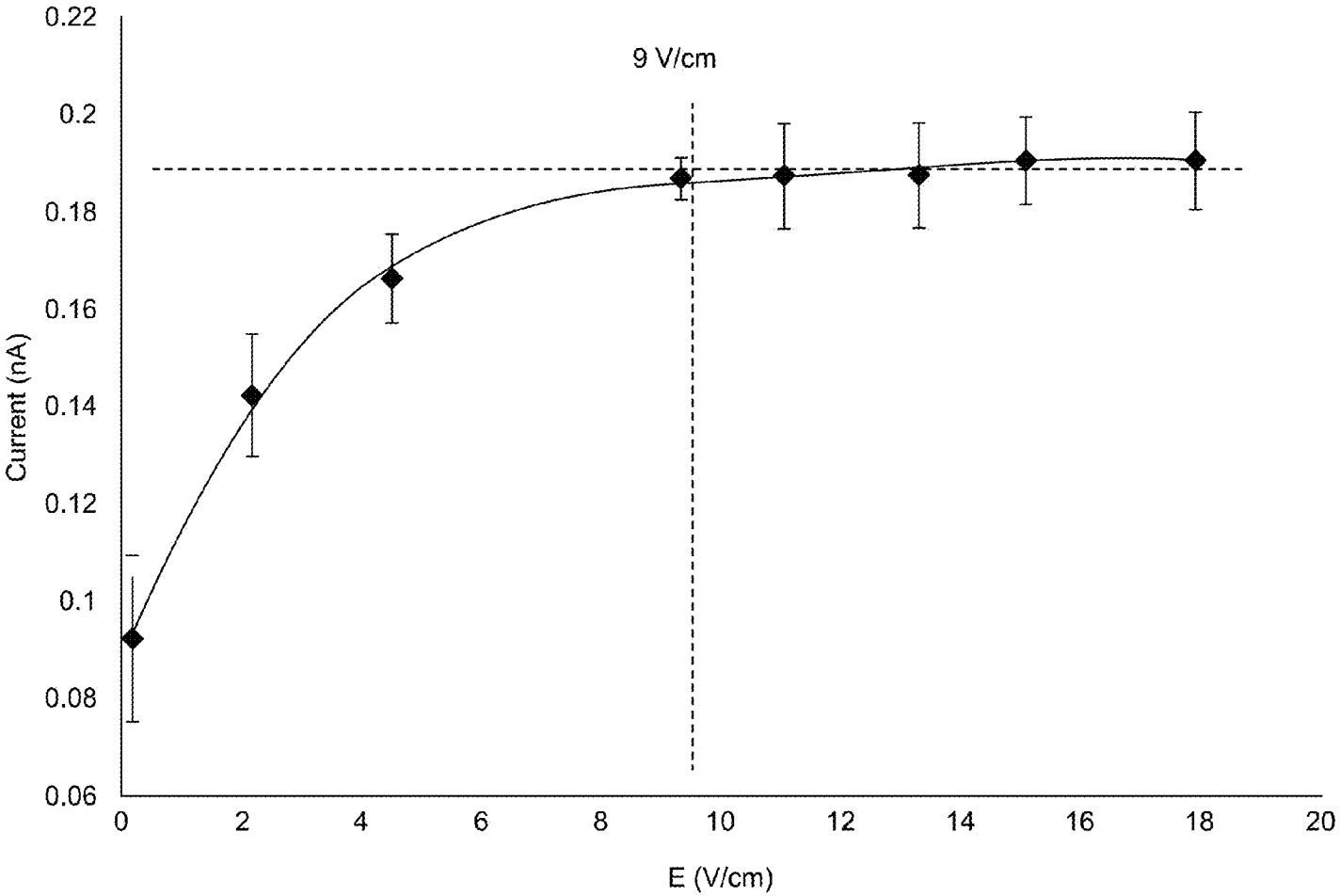
FIG. 9 is a plot of the ion funnel device characterization of the DC gradient, with ion current measured as a function of the electric field.

The RF for the ion funnel device was maintained at 160 $V_{pp}$ at 800 kHz, and the guard DC bias was set at 3 V for the entrance lens and 1 V for the exit lens. A charge collector was placed at the exit of the ion funnel device to evaluate the ion transmission. During the experiments, the pressures in the conventional ion funnel and ion funnel device housing were maintained at 4 Torr. The plot in FIG. 9 shows the dependence of the transmitted ion current on the DC gradient using the tuning mix singly charged ions in the m/z 118-2722 range. The increase of the DC gradient from 0.3 to 9.3 V/cm resulted in 2-fold sensitivity improvement. The experimental results agree with the trends observed from ion simulations shown in FIGS. 4A-4C. The decrease in ion transmission for the low DC field is related to the spatial broadening of the ion packets associated with thermal diffusion and Coulomb expansion effects on the drift motion. The ion current reaches a plateau at ~9 V/cm, suggesting a minimum requirement of 9 V/cm to avoid ion losses in the ion funnel device.

Figure 8A:
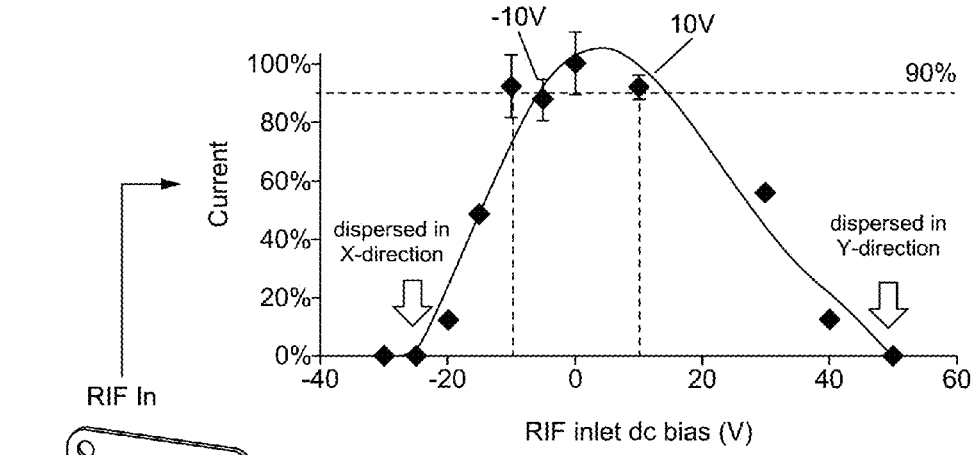
FIG. 8A shows the effect of DC bias on the ion transmission of the ion funnel device, wherein the ion current was measured as a function of the DC bias at the entrance or inlet of one of the pairs of electrodes.
Figure 8A:
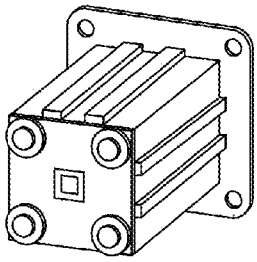
Figure 8B:
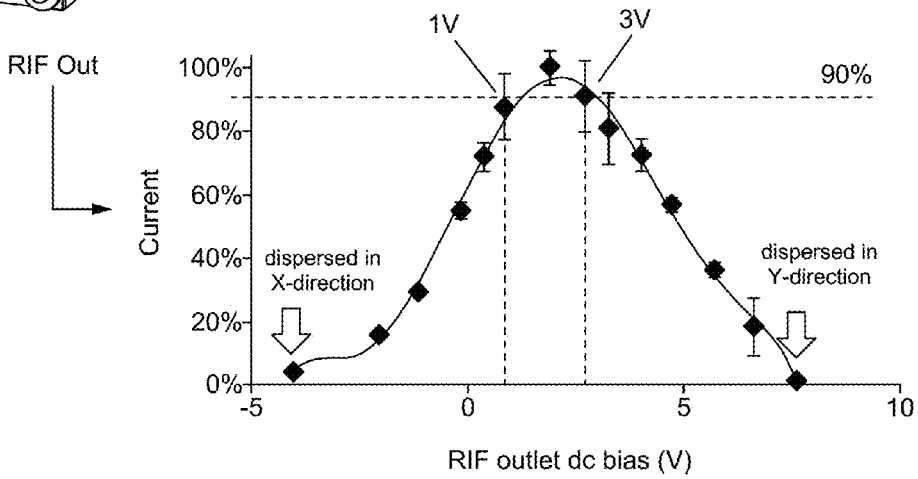
FIG. 8B shows the effect of DC bias on the ion transmission of the ion funnel device, wherein the ion current was measured as a function of the DC bias at the exit or outlet of one of the pairs of electrodes.

The ion funnel device uses different circuits, as shown in FIGS. 6A and 6B, for x-direction and y-direction electrodes allowing independent control of the DC biases at the entrance and exit of the ion funnel device. To study the effect of DC bias on the ion transmission of the ion funnel device, the ion current was measured as a function of the guard DC biases at the entrance lens as well as at the exit lens and is shown in FIGS. 8A and 8B, respectively. Comparison of the results indicates that the measured current was less sensitive to the guard DC bias at the entrance lens than at the exit lens. This is attributed to the large acceptance area of ion funnel device compared to the ion beam diameter (~3 mm) entering the ion funnel device. Results from the ion current measurements indicate that the optimum range of guard DC bias was −10 to +10 V for the entrance lens and +1 to +3 V for the exit lens of the ion funnel device. The low intensities at the higher and lower DC biases resulted from ion dispersion in the y (FIG. 3A) and x (FIG. 3F) directions, respectively.

Ion Funnel Device-SLIM Characterization.

Figure 10A:
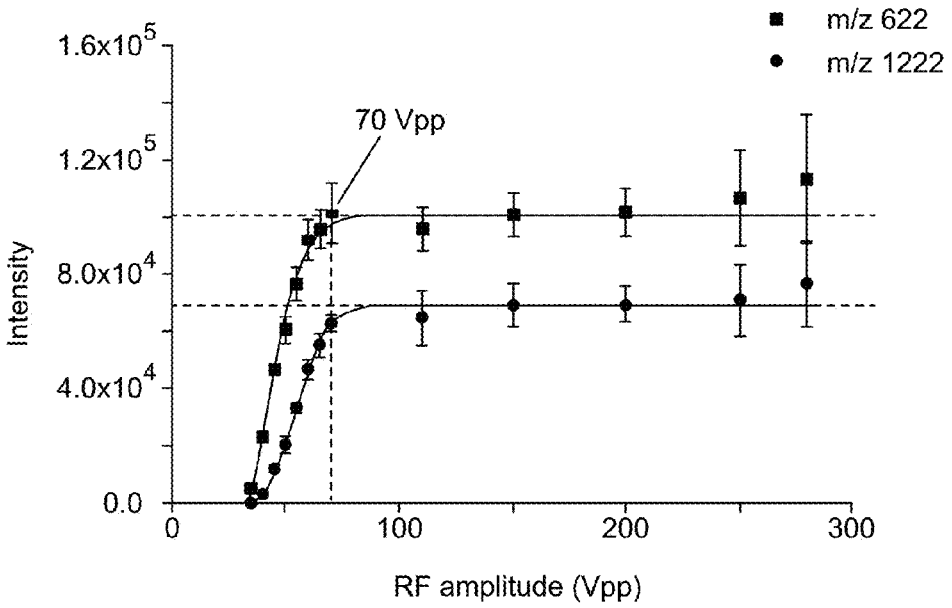
FIG. 10A shows peak intensities of certain m/z ions as a function of RF amplitude for the ion funnel device.
Figure 10B:
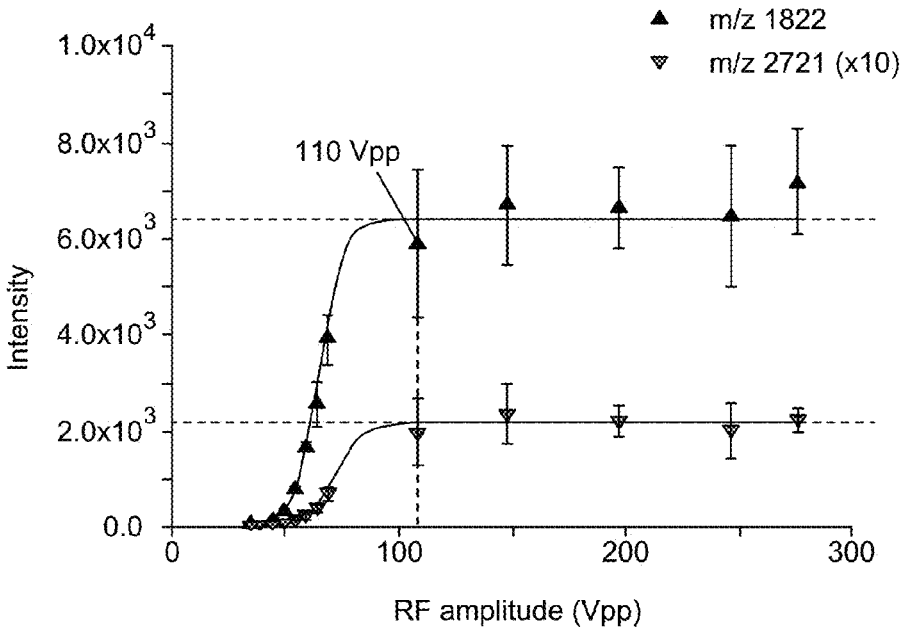
FIG. 10B shows peak intensities of certain m/z ions as a function of RF amplitude for the ion funnel device.

The ion funnel device and SLIM Device were interfaced with a time-of-flight mass spectrometer (model 6224 TOF-MS, Agilent Technologies, Santa Clara, Calif.) in order to evaluate the performance of the ESI-ion funnel device-SLIM-TOF-MS system. Details of the SLIM-TOF-MS configuration have been described previously in Webb, I. K.; Garimella, S. V. B.; Tolmachev, A. V.; Chen, T.-C.; Zhang, X.; Norheim, R. V.; Prost, S. A.; LaMarche, B.; Anderson, G. A.; Ibrahim, Y. M.; Smith, R. D. *Anal. Chem.* 2014, 86, 9169-9176. In this work, a source IFT or conventional ion funnel, coupled between the ESI and the ion funnel device, was operated at RF 0.8 MHz and 180 $V_{pp}$ while the exit funnel was operated at RF 1.2 MHz and 140 $V_{pp}$. The RF of the short quadrupole (Q0) behind the exit ion funnel was 124 $V_{pp}$ at 0.8 MHz. To ensure optimal ion transmission, the distance between the exit lens of the ion funnel device and the entrance of the SLIM Device was kept at 0.76 mm which matches the distance between the SLIM Device rung electrodes. The RF waveforms applied to the ion funnel device and SLIM Device were not phase locked as the effect of phase difference on ion motion at a pressure of 4 Torr is negligible. FIGS. 10A and 10B show the peak intensities as the function of RF amplitudes for the ion funnel device. The ion funnel device was operated at an RF frequency of 800 kHz. The selected intensities of m/z 622 and 1222 ions plateau at 70 $V_{pp}$, as shown in FIG. 10A, and the higher m/z ions at 1822 and 2721 required higher RF amplitudes for the optimal transmission through the ion funnel device. Similar RF-dependent trends were observed for the SLIM Device. For instance, the peak intensity of the m/z 2721 ion became constant at RF amplitudes higher than 110 $V_{pp}$ (FIG. 10A). The results indicate that optimal transmission of ions for the m/z range from 300 to 2700 was achieved using $V_{pp}$ (ion funnel device) >110 $V_{pp}$.

Figure 11:
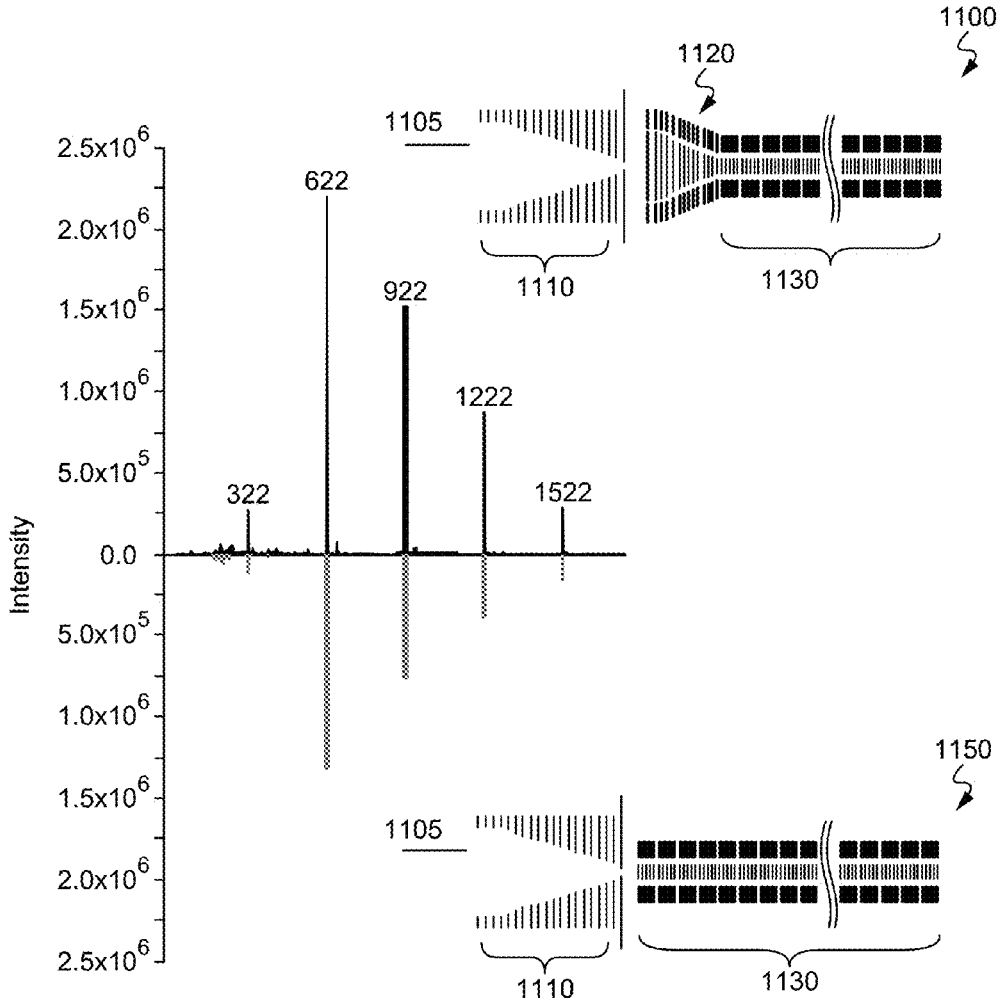
FIG. 11 shows the sensitivity comparison along a m/z range of the ion funnel interface (top) and without the ion funnel interface (bottom).
Figure 12:
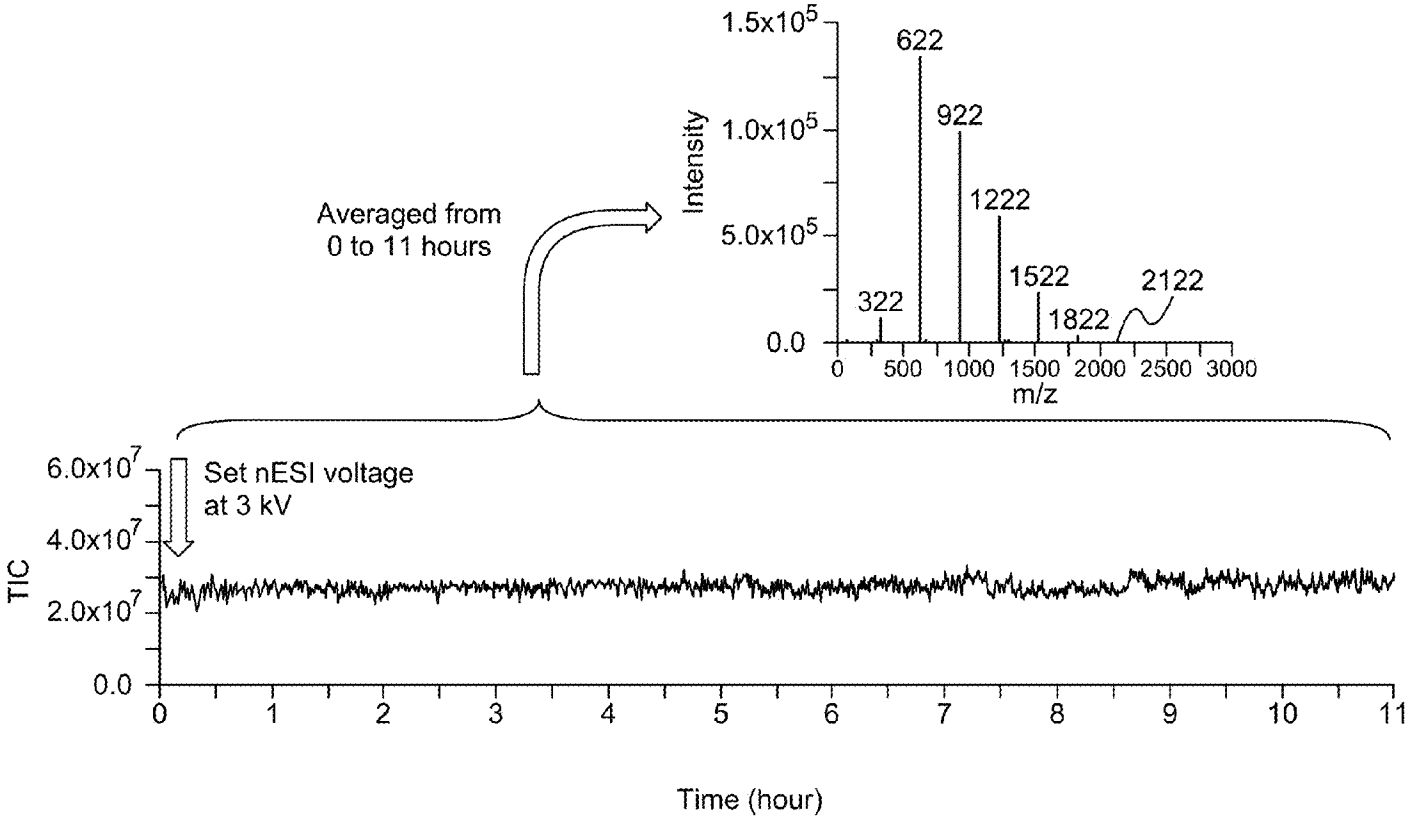
FIG. 12 shows the stability evaluation of the ion funnel interface, showing no significant intensity variation during the 11-hour test.

A back-to-back comparison of sensitivity for the conventional ion funnel 1110-ion funnel device 1120-SLIM 1130 and conventional ion funnel 1110-SLIM 1130 was performed to evaluate the performance of the system 1100 with the new ion funnel device interface and the system 1150 without the ion funnel device interface. The optimal parameters for each arrangement 1100 (top of FIG. 11) and 1150 (bottom of FIG. 11) were as previously determined. The ion funnel device was operated at RF of 120 Vpp at 800 kHz, DC gradient of 9.5 V/cm, and guard bias voltage of 3 V (entrance of ion funnel device) and 2 V (exit of ion funnel device). The SLIM Device in the conventional ion funnel-SLIM configuration was operated as follows: RF 200 $V_{pp}$ at 800 kHz; DC gradient at 15 V/cm; DC bias at 5 V. As shown in FIG. 11, a 2-fold of sensitivity improvement was demonstrated using the tuning mix ion by adding the ion funnel device compared to the conventional ion funnel-SLIM interface. Additionally, no significant variation in the spectral intensity was observed during an 11 h stability test, as shown in FIG. 12. The enhanced ion transmission of the conventional ion funnel-ion funnel device-SLIM is attributed to improved field continuity at the RIF-SLIM interface.

CONCLUSIONS

The ion funnel device was designed, fabricated, evaluated. It was also shown to improve the ion introduction to other instruments or devices, including a newly developed SLIM Device. Ion motion simulations were used to understand and determine the optimal operating parameters for ion transmission. In one embodiment, the ion funnel device was fabricated using PCB technology and incorporated into a SLIM-TOF MS system for instrument performance characterization. Three operating parameters, including RF amplitude, x-direction electrode DC bias, and y-direction electrode DC gradients, were optimized for the ion funnel device and its interface with the SLIM Device. The results of the performance evaluation show that the ion funnel device-SLIM provided a 2-fold sensitivity increase and displayed an extended robust operation (i.e., high stability), without significant discrimination over an m/z 300-2700 range.

While a number of embodiments of the present invention have been shown and described, it will be apparent to those skilled in the art that many changes and modifications may be made without departing from the invention in its broader aspects. The appended claims, therefore, are intended to cover all such changes and modifications as they fall within the true spirit and scope of the invention.

We claim:

1. An ion funnel device comprising:

a. a first pair of electrodes positioned in a first direction;

b. a second pair of electrodes positioned in a second direction; and c. a RF voltage source and a DC voltage source, wherein a RF voltage with a superimposed DC voltage gradient is applied to the first pair of electrodes, and wherein a DC voltage gradient is applied to the second pair of electrodes and a RF voltage is not applied to the second pair of electrodes.

2. The ion funnel device of claim 1 wherein each of the electrodes in the first direction has a RF phase that is shifted approximately 180 degrees from an adjacent first direction electrode.

3. The ion funnel device of claim 1 wherein the first pair of electrodes are central rung electrodes positioned in a y direction, and the second pair of electrodes are guard electrodes positioned in a x direction.

4. The ion funnel device of claim 1 wherein an outlet of the ion funnel device is coupled to one of the following: an ion mobility device, a separate ion funnel device, and a mass spectrometer device.

5. The ion funnel device of claim 1 wherein an inlet of the ion funnel device is coupled to a separate ion funnel device or an ion source.

6. The ion funnel device of claim 1 wherein the RF frequency applied to the electrodes is in the range of 0.1 kHz to 50 MHz.

7. The ion funnel device of claim 1 wherein the RF amplitude applied to the electrodes is in the range of 1V to 500 V.

8. The ion funnel device of claim 1 wherein the device is formed using at least one of the following: a printed circuit board, 3D printing, and additive printing.

9. The ion funnel device of claim 1 wherein the distance between each pair of electrodes varies from the inlet of the ion funnel device to the outlet of the ion funnel device.

10. The ion funnel device of claim 9 wherein the diameter at the outlet of the ion funnel device is smaller than the diameter at the inlet of the ion funnel device.

11. The ion funnel device of claim 1 wherein the shape of the electrodes is at least one of the following: rectangular, circular, semicircular, and curved.

12. The ion funnel device of claim 1 wherein ions moving through the device travel in a third direction, wherein the first direction, the second direction, and the third direction are different.

13. A method of making an ion funnel comprising:

a. positioning a first pair of electrodes in a first direction;

b. positioning a second pair of electrodes in a second direction;

c. applying a RF voltage with a superimposed DC voltage gradient to the first pair of electrodes; and d. applying a DC voltage gradient to the second pair of electrodes without applying a RF voltage to the second pair of electrodes.

14. The method of claim 13 wherein each of the electrodes in the first direction has a RF phase that is shifted approximately 180 degrees from an adjacent first direction electrode.

15. The method of claim 13 wherein the first pair of electrodes are central rung electrodes positioned in a y direction, and the second pair of electrodes are guard electrodes positioned in a x direction.

16. The method of claim 13 wherein an outlet of the ion funnel device is coupled to one of the following: an ion mobility device, a separate ion funnel device, and a mass spectrometer device.

17. The method of claim 13 wherein an inlet of the ion funnel device is coupled to a separate ion funnel device or an ion source.

18. The method of Clam 13 further comprising providing a DC bias range from approximately −10 to approximately +10 V for an inlet of the device, and a DC bias range from approximately 1 to approximately 3 V for an outlet of the device.

19. The method of claim 13 wherein the RF frequency applied to the electrodes is in the range of 0.1 kHz to 50 MHz.

20. The method of claim 13 wherein the RF amplitude applied to the electrodes is in the range of 1V to 500 V.

21. The method of claim 13 wherein the device is formed on a printed circuit board.

22. The method of claim 13 wherein the distance between each pair of electrodes varies from the inlet of the ion funnel device to the outlet of the ion funnel device.

23. The method of claim 22 wherein the diameter at the outlet of the ion funnel device is smaller than the diameter at the inlet of the ion funnel device.

24. The method of claim 13 wherein the shape of the electrodes is at least one of the following: rectangular, circular, semicircular, and curved.

25. The method of claim 13 wherein ions moving through the device travel in a third direction, wherein the first direction, the second direction, and the third direction are different.

26. An ion funnel device comprising:

a. a first pair of electrodes positioned in a first direction;

b. a second pair of electrodes positioned in a second direction; and c. a RF voltage source and a DC voltage source, wherein a RF voltage with a superimposed DC voltage gradient is applied to the first pair of electrodes, wherein only a DC voltage gradient is applied to the second pair of electrodes, and wherein ions moving through the device travel in a third direction.

* * * * *